US007225560B2

(12) United States Patent
Govek et al.

(10) Patent No.: US 7,225,560 B2
(45) Date of Patent: Jun. 5, 2007

(54) COMPUTER TO PLATE CURING SYSTEM

(75) Inventors: Jeffrey P. Govek, Dallas, TX (US); Steven M. Person, Seagoville, TX (US); David M. Pizzillo, Carrollton, TX (US); Phillip E. Jones, Carrollton, TX (US); John E. Aylor, Fort Worth, TX (US); David D. Douglas, Garland, TX (US)

(73) Assignee: Printing Research, Inc., Dallas, TX (US)

( * ) Notice: Subject to any disclaimer, the term of this patent is extended or adjusted under 35 U.S.C. 154(b) by 0 days.

(21) Appl. No.: 11/051,277

(22) Filed: Feb. 4, 2005

(65) Prior Publication Data

US 2006/0174508 A1 Aug. 10, 2006

(51) Int. Cl.
*F26B 3/34* (2006.01)

(52) U.S. Cl. ..... 34/268; 34/269

(58) Field of Classification Search ..... 34/266, 34/267, 268, 269, 275; 430/303; 101/404.1
See application file for complete search history.

(56) References Cited

U.S. PATENT DOCUMENTS 4,363,176 A * 12/1982 Jargiello et al. ..... 34/275
4,485,565 A * 12/1984 Ertl et al. ..... 34/267
4,554,437 A * 11/1985 Wagner et al. ..... 219/388
5,020,237 A * 6/1991 Gross et al. ..... 34/265
5,948,595 A 9/1999 Watanabe
5,966,836 A * 10/1999 Valdez et al. ..... 34/448
6,040,113 A 3/2000 Van Damme et al.
6,294,114 B1 * 9/2001 Muirhead ..... 264/40.6
6,352,811 B1 3/2002 Patel et al.
6,352,812 B1 3/2002 Shimazu et al.
6,458,510 B1 10/2002 Vermeersch et al.
6,558,875 B1 5/2003 Toshimitsu et al. ..... 430/302
6,599,676 B2 7/2003 Savariar-Hauck et al.

(Continued)

FOREIGN PATENT DOCUMENTS

DE 1955378 5/1971

(Continued)

OTHER PUBLICATIONS

"International Search Report and Written Opinion," PCT/US2006/003451, May 23, 2006, 12 pgs.

(Continued)

*Primary Examiner*—Kenneth Rinehart
(74) *Attorney, Agent, or Firm*—Conley Rose, P.C.

(57) ABSTRACT

A system for curing printing plates with controlled radiant energy sources. A conveyor moves a printing plate through a chamber having energy radiators above and below the conveyor. Power to the radiators is controlled for each radiator or to groups of radiators defining radiation zones. Curing time may be controlled by adjusting power to the radiators and adjusting the conveyor speed. Sensors detect a plate as it enters and exits the chamber. Heat sensors may detect chamber or plate temperatures. A color sensor may detect plate color as an indicator of degree of curing. A computer system stores curing scenarios and uses the sensor signals and operator inputs to control power to the radiators and conveyor speed to provide uniform curing of the plate.

19 Claims, 6 Drawing Sheets

U.S. PATENT DOCUMENTS

| | | | | |
|---|---|---|---|---|
| 6,620,582 | B2 | 9/2003 | Hirabayashi | |
| 6,675,710 | B2 | 1/2004 | Friedman et al. | |
| 6,677,106 | B2 | 1/2004 | Blum et al. | |
| 6,707,014 | B1 * | 3/2004 | Corey et al. | 219/494 |
| 6,716,566 | B2 | 4/2004 | Aoshima | |
| 6,861,202 | B2 | 3/2005 | Toshimitsu et al. | 430/302 |
| 2002/0001776 | A1 | 1/2002 | Mori et al. | |
| 2002/0144991 | A1 | 10/2002 | Fromson et al. | |
| 2002/0177071 | A1 | 11/2002 | Okamoto | 430/270.1 |
| 2003/0118949 | A1 | 6/2003 | Ray et al. | |
| 2003/0124454 | A1 | 7/2003 | Savariar-Hauck et al. | |
| 2003/0157429 | A1 | 8/2003 | Blum et al. | |
| 2003/0200885 | A1 | 10/2003 | Shimazu et al. | |
| 2003/0200886 | A1 | 10/2003 | Vermeersch et al. | |
| 2003/0219673 | A1 | 11/2003 | Tao et al. | |
| 2003/0224284 | A1 | 12/2003 | Tao | |
| 2005/0037287 | A1 | 2/2005 | Verschueren et al. | |
| 2005/0048404 | A1 | 3/2005 | Okamoto | 430/302 |

FOREIGN PATENT DOCUMENTS

| | | | |
|---|---|---|---|
| DE | 2648438 | B1 | 12/1978 |
| DE | 10035430 | A1 | 2/2002 |
| EP | 0 982 627 | A2 | 3/2000 |
| EP | 1 074 889 | A2 | 2/2001 |
| EP | 1176031 | A1 | 1/2002 |
| EP | 1 356 927 | A2 | 10/2003 |
| GB | 1330139 | | 9/1973 |
| GB | 1413374 | | 11/1975 |
| GB | 2205419 | A | 12/1988 |
| JP | 2002/343697 | | 11/2002 |
| WO | WO 2005/015318 | A1 | 2/2005 |
| WO | WO 2005/052694 | A2 | 6/2005 |

OTHER PUBLICATIONS

"International Search Report and Written Opinion," PCT/US2006/0-3940, Jun. 11, 2006, 15 pgs.

* cited by examiner

COMPUTER TO PLATE CURING SYSTEM

CROSS-REFERENCE TO RELATED APPLICATIONS

None

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present disclosure is directed to a system for printing presses, and more particularly, but not by way of limitation, to a system for curing an imaged printing plate.

BACKGROUND OF THE INVENTION

Lithographic printing is based on the immiscibility of oil and water, wherein the oily ink material preferentially adheres to the image areas and the water or fountain solution preferentially adheres to the non-image areas. When a suitably prepared printing plate is moistened with water and an ink is then applied, the non-image areas adhere the water and repel the ink while the image areas adhere the ink and repel the water. The ink on the image areas of the printing plate is then transferred to a substrate, for example paper, perhaps after first being transferred to an intermediate surface and from the intermediate surface to the substrate.

Printing plates may be composed of a thin layer of sensitive chemicals on an aluminum plate. Imaging or exposing the printing plates causes the chemicals to react, leaving some regions exposed and other regions unexposed. After imaging, the printing plates are developed. According to one method of developing, the printing plates are treated in one or more chemical baths to remove exposed or non-exposed areas while leaving other areas in place. When properly developed, the printing plate exhibits the immiscibility of oil and water properties discussed above. Printing plates may be imaged using a variety of technologies including ultraviolet, infrared, and visible wavelength light radiated through a mask or using an infrared laser or other laser.

An imaged and developed printing plate may be cured or baked to increase the run life of the printing plate. Printing plates may be able to print many thousands of copies, for example for a newspaper edition or an issue of a magazine. Some printing runs, however, produce so many copies that several sets of printing plates wear out and need replacing through the course of the printing run. Generally it is desirable to be able to extend printing plate life by curing or baking printing plates. Conventional curing has been performed by passing an imaged and developed printing plate through a convection oven to raise to plate temperature to a narrow temperature required to achieve curing while avoiding overheating that can damage the layer of chemicals or weaken the aluminum plate. For negative plates, an imaged plate may be heated in a second convection oven after imaging and before developing. Curing is often referred to as baking because of the convection ovens used for curing. However, it has proven difficult to precisely control the temperature in such ovens and in particular to provide a uniform temperature on all parts of a printing plate. Non-uniform heating results in nonuniform curing and therefore nonuniform printing characteristics for the finished plate.

SUMMARY OF THE INVENTION

A system for curing printing plates with power controlled energy radiators, for example infrared or ultraviolet lamps. A conveyor moves a printing plate through a chamber having energy radiators above and, preferably, below the conveyor. Power to the energy radiators is controlled for each energy radiator individually, or in groups of radiators, defining radiation zones to provide uniform curing of the plate. Curing may be controlled by adjusting power to the energy radiators and/or adjusting the conveyor speed.

In one embodiment, sensors detect a printing plate as it enters and exits the chamber. A computer system stores curing scenarios including power profiles and uses the sensor signals to control power to the energy radiators and conveyor speed to provide uniform curing of the plate.

In one embodiment, a curing scenario may be selected based in part on the rate at which plates are processed through the chamber including conveyor speed.

In one embodiment, a curing scenario power profile includes a power ramp up portion and a power ramp down portion.

Sensors may detect chamber or plate temperatures. Curing scenarios may be selected or adjusted according to the chamber temperature and/or the plate temperature.

A color densitometer may be used to measure curing based on color of a plate and a power profile and/or the conveyor speed may be adjusted to increase or decrease curing as needed.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION OF THE PREFERRED EMBODIMENTS

It should be understood at the outset that although an exemplary implementation of one embodiment of the present disclosure is illustrated below, the present system may be implemented using any number of techniques, whether currently known or in existence. The present disclosure should in no way be limited to the exemplary implementations, drawings, and techniques illustrated below, including the exemplary design and implementation illustrated and described herein.

Some imaged and developed printing plates may experience longer run lives if they are first cured before use, for example by irradiating with heat or with ultraviolet light in accordance with the present invention. It is desirable to control the radiation applied to the printing plates carefully to properly cure the printing plates. Excessive radiation levels and/or irradiating too long may degrade the printing plate image and/or the metallurgical properties of the aluminum backing of the printing plate. For example, excessive heat may increase the malleability of the aluminum backing and thereby reduce the run life of the printing plate. Inadequate irradiation and/or curing for too short a time interval may not fully cure the printing plate. Hot air convection ovens for curing printing plates support control of a temperature set point and the length of time of heating, but do not support control of differential heating across the area of the printing plate. Convection ovens require time to bring a heating chamber up to the temperature set point. Because of the time required to achieve the temperature set point, convection ovens may be left continuously on during operating hours, which may waste energy resources in some cases. Convection ovens may be large and bulky. An alternative curing apparatus which can rapidly achieve the temperature set point and promotes differential curing across the area of the printing plate may be helpful.

Figure 1A:
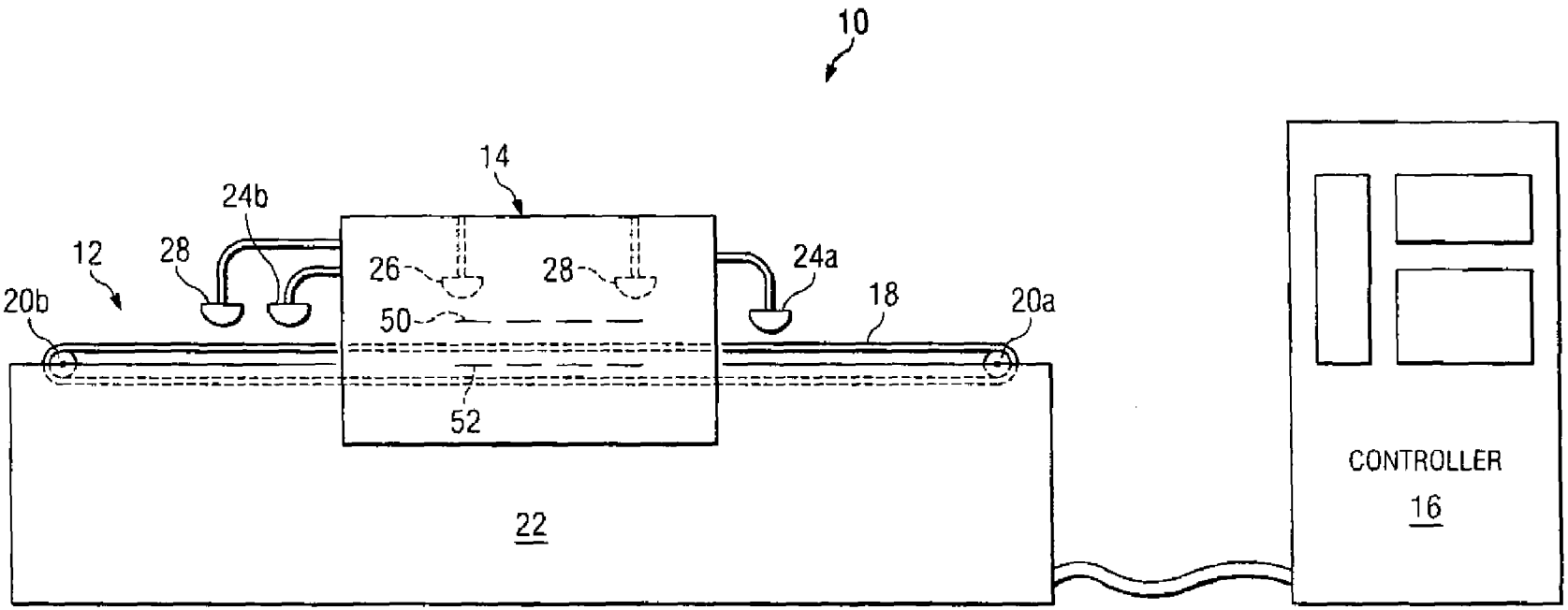
FIG. 1*a* is a diagram of a curing system according to an embodiment of the present disclosure.

Turning now to FIG. 1*a*, a curing system 10 is illustrated. A conveyer 12 is operable to move an imaged and developed printing plate into, through, and out of a curing chamber 14. The conveyer 12 may move the printing plate into and out of the curing chamber 14 using continuous motion. Alternately, the conveyer 12 may move the printing plate into the curing chamber 14 and stop, the printing plate may be irradiated with energy in the curing chamber, and the conveyer 12 may then move the printing plate out of the curing chamber 14 and stop, which may be referred to as discontinuous motion. The curing chamber 14 is operable to differentially irradiate the printing plate under the control of a controller 16 as the conveyer 12, also under the control of the controller 16, moves the printing plate through the curing chamber 14 using either continuous or discontinuous motion. The conveyer 12 may comprise a conveyer belt 18 supported by two or more conveyer rollers 20. In FIG. 1, two rollers 20 are depicted—a first conveyer roller 20*a* and a second conveyer roller 20*b*—but in another embodiment more rollers 20 may be employed to provide the needed support to the conveyer belt 18. At least one of the rollers 20 is coupled to an electric motor which rotates the roller 20, and hence provides linear motion to the conveyer belt 18 through the curing chamber 14, under the command of the controller 16. The conveyer belt 18 may be moved at different speeds by the roller 20, as commanded by the controller 16. In an embodiment, more than one of the rollers 20 may be coupled to the same motor or different motors to provide motive force to the conveyer belt 18. The conveyer 12 and the curing chamber 14 may be supported by a frame structure 22.

A first edge detector 24*a* may be employed to detect entry of the printing plate into the curing chamber 14. A second edge detector 24*b* maybe employed to detect exit of the printing plate from the curing chamber 14. One or more temperature sensors 26 may be located in the curing chamber 14 to monitor temperature of the curing chamber 14 or the printing plate. One or more infrared thermocouples 28 may be located inside and/or outside the curing chamber 14 to monitor the temperature of a printing plate. One or more color densitometers 28 may be located inside and/or outside the curing chamber 14 to monitor the color of the printing plate.

Figure 1B:
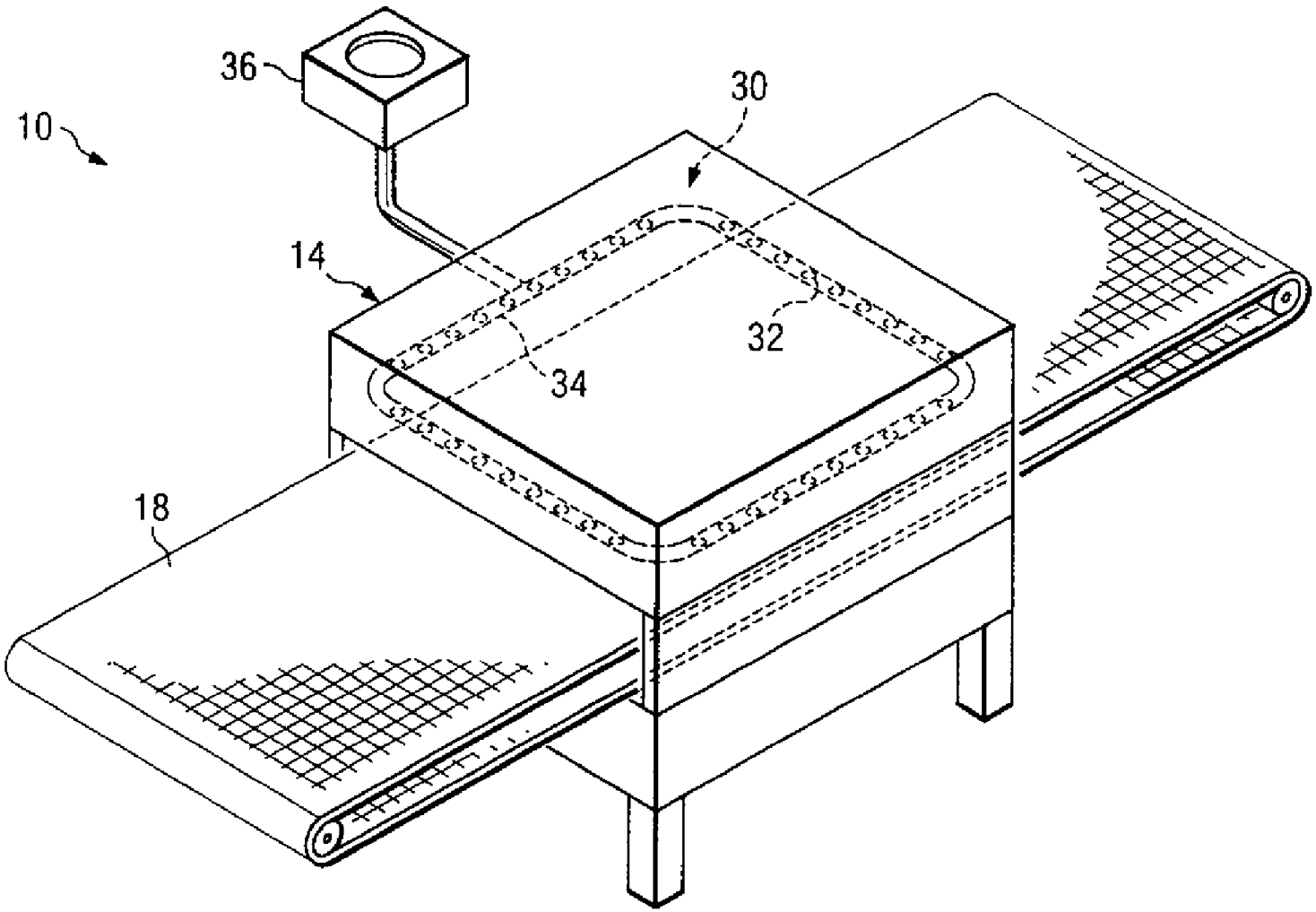
FIG. 1*b* is a diagram of an extraction system coupled to the curing system according to an embodiment of the present disclosure.

Turning now to FIG. 1*b*, an embodiment of the curing system 10 including an extraction system 30 is depicted. The extraction system 30 is operable to draw air, gases, and air suspended particles out of the curing chamber 14. The extraction system 30 removes matter which may ablate from the printing plates as they cure. The extraction may prevent or diminish the deposition of ablated material on the interior of the curing chamber 14 and the risk that deposited material may ablate off the interior of the curing chamber 14 and fall onto the printing plates, damaging the printing plates. The extraction system 30 may also be employed to cool the interior of the curing chamber 14 between printing plates, the cooling operation taking place at least partly through the action of convective cooling.

The extraction system 30 comprises a plurality of ports 32 disposed above and proximate to the conveyer belt 18. In this embodiment, the ports are distributed along the inside of both sides and both ends of the curing chamber 14. The ports 32 may be perforations of a conduit 34 attached to the interior of the curing chamber 14. The conduit 34 is attached to a source of low pressure air 36, for example a multi-speed fan. In an alternate embodiment, the ports 32 perforate the side walls of the curing chamber 14, an external manifold is attached sealingly to the side walls of the curing chamber 14, and the source of low pressure air 36 is attached to the external manifold. In an embodiment, the ports 32 and conduit 34 may be located only on the side walls of the chamber 14, parallel to the direction of motion of the printing plates passing through the curing chamber 14. The pressure differential between ambient pressure and the pressure provided by the source of low pressure air 36 may be increased to increase in-flow of air when cooling operations are conducted, for example by increasing the speed of a multi-speed fan. The source of low pressure air 36 may scrub or otherwise remove undesirable gases and particulate matter before venting to ambient. Ambient air may enter chamber 14 through openings in the ends of chamber 14 through which the conveyer 18 passes. The source of low pressure air 36 may be attached by one or more pipes or flexible hoses to the conduit 34 or external manifold. In an embodiment, a plurality of sources of low pressure air 36 may be employed.

Figure 2A:
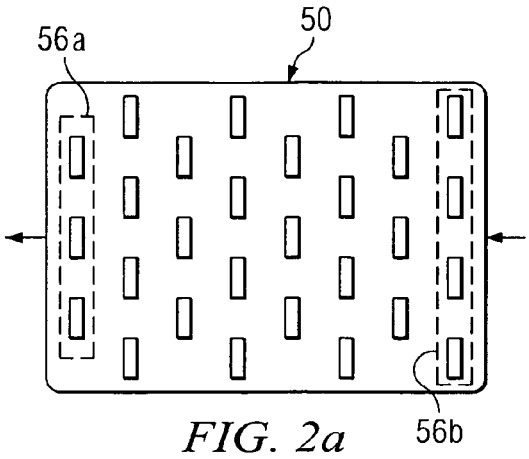
FIG. 2*a* is a diagram depicting alignment of an upper array of energy radiators, including zones, according to an embodiment of the present disclosure.
Figure 2B:
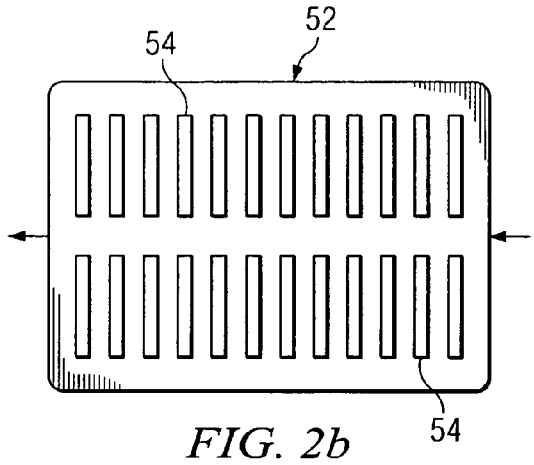
FIG. 2*b* is a diagram depicting alignment of a lower array of energy radiators according to an embodiment of the present disclosure.

Turning now to FIGS. 2*a* and 2*b*, an upper radiator array 50 and a lower radiator array 52 are illustrated. The upper radiator array 50 and the lower radiator array 52 are both components of the curing chamber 14. The upper radiator array 50 is disposed above conveyer belt 18, and the lower radiator array 52 is disposed below the conveyer belt. Both the plane of the upper radiator array 50 and the plane of the lower radiator array 52 are disposed substantially parallel to the plane of the conveyer belt 18. The conveyer belt 18 is substantially transparent to energy radiation and preferably to airflow and is therefore referred to as energy transparent. The conveyer belt 18 may be formed of a mesh material, a webbing material, a net-like material, or an energy transparent material. It may be preferable that the material of the conveyer belt 18 tend to not absorb and/or retain heat energy. When formed of a mesh or webbing material, the structural elements of the mesh or webbing may not themselves be energy transparent, but the spaces between the structural elements are open allowing transmission of radiant energy and airflow for convective or forced air heating and cooling. The conveyer belt 18 may be formed of a substantially continuous sheet or film of substantially energy transparent material allowing energy radiated by the lower radiator array 52 to directly irradiate the bottom of the printing plate, through the energy transparent material. In an embodiment, the conveyer belt 18 may comprise a pair of tracks driven synchronously by the one of the rollers 20, the tracks so disposed to fittingly receive the printing plate.

Figure 2C:
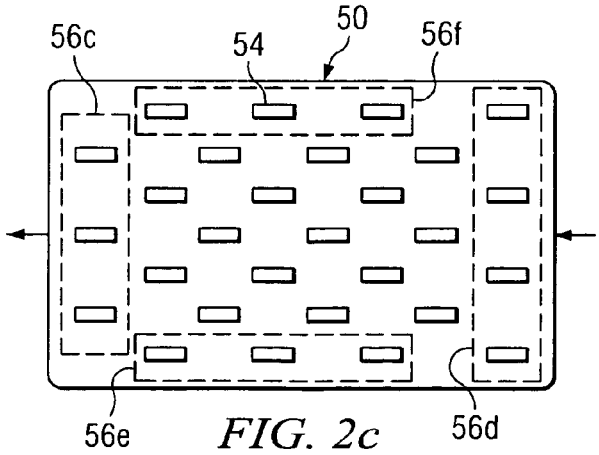
FIG. 2*c* is a diagram depicting alternate radiation zones of an upper array of energy radiators according to an embodiment of the present disclosure.

Both the upper radiator array 50 and the lower radiator array 52 include a plurality of energy radiators 54. Each energy radiator 54 may be individually controlled by the controller 16. In this embodiment, the energy radiators 54 are linear lamps, the energy radiators 54 in the upper radiator array 50 and the energy radiators 54 in the lower radiator array 52 are aligned substantially perpendicular to, the direction of travel of the conveyer 12. In other embodiments, the alignment of energy radiators 54 in the upper radiator array 50 and the energy radiators 54 in the lower radiator array 52 may be perpendicular, parallel (as shown in FIG. 2*c*), or biased with respect to the direction of travel of the conveyer 12. In the preferred embodiment, the upper radiator array 50 comprises 67 individual energy radiators 54. In another embodiment, other alignments of the energy radiators 54 may be employed. In the preferred embodiment, the energy radiators 54 are linear tungsten halogen lamp infrared radiator elements. In alternative embodiments the energy radiators 54 may be Calrod™ infrared radiator elements or other energy radiators. In the preferred embodiment, the energy radiators 54 disposed in the upper radiator array 50 are each rated to radiate up to a maximum of 1 kW and the energy radiators 54 disposed in the lower radiator array 52 are each rated to radiate up to a maximum of 2 kW. In another embodiment, a different energy radiator 54, for example an ultraviolet lamp, may be employed.

In an embodiment, the interior surfaces of the upper radiator array 50, the lower radiator array 52, and the curing chamber 14 may be formed of or coated with a material having low thermal capacity and low thermal conductivity so that energy radiated by the upper radiator array 50 and the lower radiator array 52 is not absorbed and reemitted undesirably. Alternately, some of the surfaces of the upper radiator array 50, the lower radiator array 52, and/or the curing chamber 14 may be covered with fiberglass sheets covered with a thin reflective metal sheet.

The energy radiators 54 may be controlled by the controller 16 to effect zoned energy radiation. For example, a first radiation zone 56 may be comprised of the energy radiators 54 on the leading and trailing edges of the upper radiator array 50. The energy radiators 54 which comprise the first radiation zone 56 may be supplied the same power levels by the controller 16. Alternately, a second radiation zone 56*a* may be defined comprised of the energy radiators 54 on the leading edge of the upper radiator array 50 while a third radiation zone 56*b* may be defined comprised of the energy radiators 54 on the trailing edge of the upper radiator array 50. The energy radiators 54 which comprise the second radiation zone 56*a* may be supplied a different power level by the controller 16 from the power level supplied by the controller 16 to the third radiation zone 56*b*.

Figure 2D:
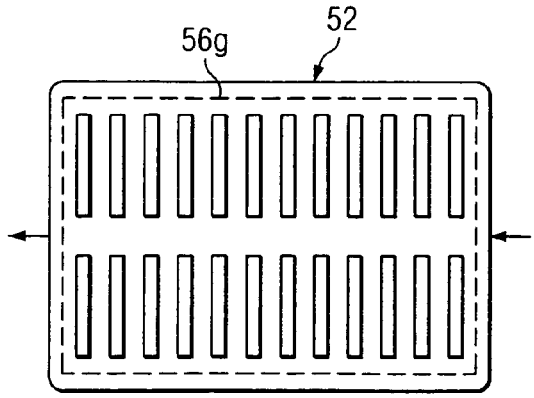
FIG. 2*d* is a diagram depicting a radiation zone of a lower array of energy radiators according to an embodiment of the present disclosure.

Turning now to FIGS. 2*c* and 2*d*, an alternate zoning of energy radiators 54 is depicted. A fourth radiation zone 56*c* is composed of some energy radiators 54 on the leading edge and a fifth radiation zone 56*d* is composed of some energy radiators 54 on the trailing edge of the upper radiator array 50. A sixth radiation zone 56*e* and a seventh radiation zone 56*f* are composed of the energy radiators 54 on either side of the upper radiator array 50. An eighth radiation zone 56*g* is composed of all the energy radiators 54 on the lower radiator array 52. The five radiation zones 56*c*, 56*d*, 56*e*, 56*f*, and 56*g* have been demonstrated to advantageously cure printing plates in a laboratory prototype. It may be that the fifth radiation zone 56*d* raises the energy level of the printing plate as it enters the curing chamber 14 to just below the operable curing energy level of the printing plate. The fourth radiation zone 56*c*, under which the printing plate passes when exiting the curing chamber 14, may provide the last increment of energy to cause the curing process to occur. The sixth radiation zone 56*e* and the seventh radiation zone 56*f* may maintain the energy levels near the edges of the printing plate which otherwise may be subject to energy loses at the edges of the curing chamber 14. In using the laboratory prototype, the sixth radiation zone 56*e* and the seventh radiation zone 56*f* were found necessary to cure outside edge portions of the printing plates. The eighth radiation zone 56*g* may reduce or prevent laminar energy differentials in the aluminum backing of the printing plate which otherwise may undesirably warp the printing plate.

The plurality of energy radiators 54 in both the upper radiator array 50 and the lower radiator array 52 promote flexible definition of radiation zones, for example the radiation zones 56, 56*a*, 56*b*, 56*c*, 56*d*, 56*e*, 56*f*, and 56*g*. In an embodiment, however, fewer energy radiators 54 may be deployed in the upper radiator array 50 and/or the lower radiator array 52 and one or more radiation zones may be permanently defined. As practical knowledge of the effects of zoned radiation is gained in the field, it may be preferable to deploy the upper radiator array 50 and the lower radiator array 52 with fewer energy radiators 54 and permanently defined radiation zones as a design simplification which reduces manufacturing cost and increases system reliability.

In an embodiment, the one or more temperature sensors 26 may include one or more infrared sensors, e.g. infrared thermocouples, responsive to a range of temperatures which the printing plate, for example a printing plate, may be expected to exhibit during the curing process but unresponsive to the higher temperatures associated with the energy radiators 54. In an embodiment, a plurality of infrared sensors may be disposed to provide a low resolution image, for example a four-by-four pixel image or an eight-by-eight pixel image, of the temperature of one or both surfaces of the printing plate. In an embodiment, several infrared sensors may be deployed in substantially a single file and positioned near where the printing plate exits from the curing chamber 14. In an embodiment, a forward looking infrared (FLIR) sensor may provide a high resolution image of the temperature of one or both surfaces of the printing plate.

Figure 3:
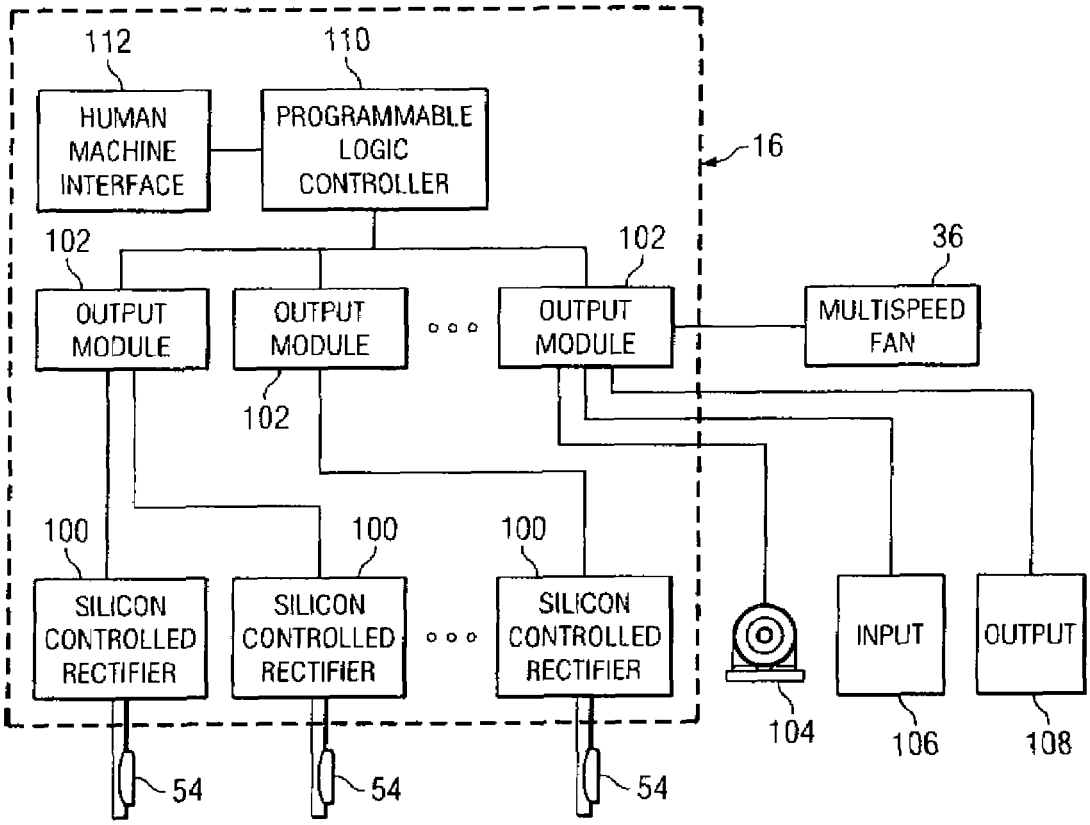
FIG. 3 is a block diagram of a system for controlling a plurality of energy radiators according to an embodiment of the present disclosure.

Turning now to FIG. 3, some of the components of the controller 16 are depicted coupled to components of the curing system 10. A plurality of power controllers 100 are coupled to electrical power supplies (not shown) and deliver variable electrical power to the energy radiators 54 in response to a control input. The power controllers 100 may be silicon controlled rectifier (SCR) based power controllers, solid state relays, duty cycle control components, or other power throttling type of device. A plurality of output modules 102 are operable to control the power controllers 100 and a conveyer motor 104. The output modules 102 may also interface to one or more discrete inputs 106 and one or more discrete outputs 108. The discrete input 106 may include an edge detection indication, for example from the first edge detector 24*a*, when the printing plate enters the curing chamber 14. The discrete outputs 108 may turn on a red light, for example, when the curing chamber 14 is hot, control the speed of fan 36, etc. The output modules 102 are controlled by a programmable logic controller (PLC) 110. Generally, a PLC 110 is a computer adapted to performing automation control activities. A human machine interface (HMI) 112 provides a means for an operator to define operating scenarios, to activate predefined operating scenarios, and to operate the curing system 10 manually. In an embodiment, the HMI 112 may be provided by a general purpose computer system which executes computer programs such as a genetic algorithm to control power to optimize a plurality of characteristics of the printing plate changed by curing or a genetic algorithm directed to optimize the printing plate curing characteristics using stored results of a plurality of printing plate curing cycles. In an embodiment, the functions of the PLC 110 and the HMI 112 may be combined in a single general purpose computer system.

In the preferred embodiment, the PLC 110 is an off the shelf item available from Allen Bradley as model SLC 5/03. In the preferred embodiment, the HMI 112 is available from Red Lion Controls, 20 Willow Springs Circle, York, Pa. 17402, USA. In the preferred embodiment, the power controller 100 is a SCR based power controller from Avatar with model number A1P-2430 or A3P-4800. In other embodiments, other PLCs 110, power controllers 100, and/or HMI 112 may be employed.

The HMI 112 may provide a curing scenario creation tool which promotes ease of defining new curing scenarios or curing recipes. The curing scenarios or curing recipes may be stored in the HMI 112. The curing scenario creation tool may request a user to define an energy radiation level ramp-up time interval during which the radiation level of the energy radiators 54 are ramped up, a sustained radiation level time interval during which the radiation level of the energy radiators 54 are maintained at a constant high level, and a ramp-down time interval during which the radiation level of the energy radiators 54 are ramped down. Ramping-up and ramping-down the power levels supplied to the energy radiators 54 may extend the life of the energy radiators 54, conserve energy consumption, and/or better balance radiation. The curing scenario creation tool may request the user to define a maximum scenario weighting coefficient $C_s$ in the range 0.0 to 1.0. The curing scenario creation tool may request the user to define a weighting coefficient $C_w$ for each energy radiator 50 in the range from 0.0 to 1.0. The output of any energy radiator may then be controlled as:

$$P(t)=C_r(t)*C_s*C_w*P_{max} \quad (1)$$

Where P(t) is the power supplied to the energy radiator 50 as a function of time, $C_r(t)$ is a function of time that represents ramping the power output of the energy radiator 50 up and down and $P_{max}$ is the maximum power output capability of the energy radiator 50. The ramping time function $C_r(t)$ will be equal to 1.0 during the sustained radiation time interval, will ramp linearly with time from 0.0 to 1.0 during the ramp-up time interval, will ramp linearly with time from 1.0 to 0.0 during the ramp-down time interval, and will be 0.0 before the start of the radiation period or the ramp-up interval. Alternately, the ramping time function $C_r(t)$ may linearly ramp up from and ramp-down to some minimum level, for example 0.2. Maintaining the power supplied to the energy radiators 54 at a minimum level may promote more rapid energy delivery from the energy radiators 54 because there may be some time and energy overhead involved in performing a "cold start" curing operation. The ramp-up interval may commence when the printing plate is moved by the conveyer 12 into the curing chamber 14, for example as determined by an edge detector 24 that may provide a discrete input 106.

Figure 4:
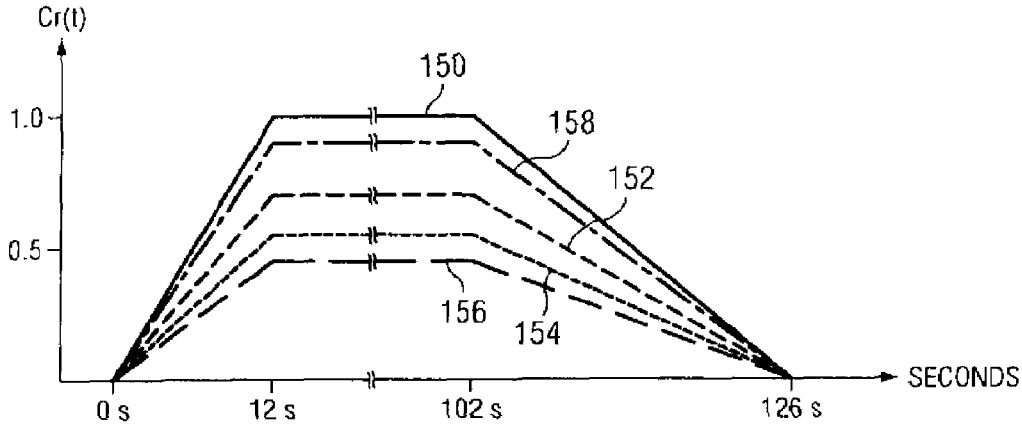
FIG. 4 is a graph of a ramping time function and individual power profiles for radiation zones according to one embodiment of the disclosure.

Turning now to FIG. 4, a graph illustrates a first ramping time function $C_r(t)$ 150 and several power profiles, i.e. power as a function of time, P(t) for the exemplary radiation zones 56*c*, 56*d*, 56*e*, 56*f*, and 56*g* defined in FIGS. 2*c* and 2*d* versus time. The first power profile $C_r(t)$ 150 may have been defined using the curing scenario creation tool. The time scale 0 position is located where the printing plate is first detected entering the curing chamber 14, as for example by the first edge detector 24*a*. The ramp-up time interval has been defined to be 12 seconds, and the graph shows $C_r(t)$ 150 linearly increasing from 0 at 0 seconds to 1 at 12 seconds. The sustained radiation level time interval has been defined to be 90 seconds, and the graph shows $C_r(t)$ 150 maintaining at a value of 1 for 90 seconds from 12 seconds after edge detection of the printing plate to 102 seconds after edge detection of the printing plate, an interval of 90 seconds. The ramp-down time interval has been defined to be 24 seconds, and the graph shows $C_r(t)$ 150 linearly decreasing from 1 at 102 seconds to 0 at 126 seconds.

For the exemplary curing scenario depicted by FIG. 4, the value of $C_s$ is 0.9 and the value of $P_{max}$ is 1.0 for the P(t) for each of the radiation zones 56*c*, 56*d*, 56*e*, 56*f*, and 56*g*. The weighting coefficient of the eighth radiation zone 56*g* $C_{w,8}$=0.5, the seventh radiation zone 56*f* $C_{w,7}$=0.6, the sixth radiation zone 56*e* $C_{w,6}$=0.6, the fifth radiation zone 56*d* $C_{w,5}$=0.8, and the fourth radiation zone 56*c* $C_{w,4}$=1.0. These weightings, used in the equation (1) above, lead to a graph of a first power profile $P_1(t)$ 152 representing power supplied to the fifth radiation zone 56*d*, a graph of a second power profile $P_2(t)$ 154 representing power supplied to the sixth radiation zone 56*e* and to the seventh radiation zone 56*f*, a graph of a third power profile $P_3(t)$ 156 representing power supplied to the eighth radiation zone 56*g*, and a graph of a fourth power profile $P_4(t)$ 158 representing power supplied to the fourth radiation zone 56*c*.

Figure 5:
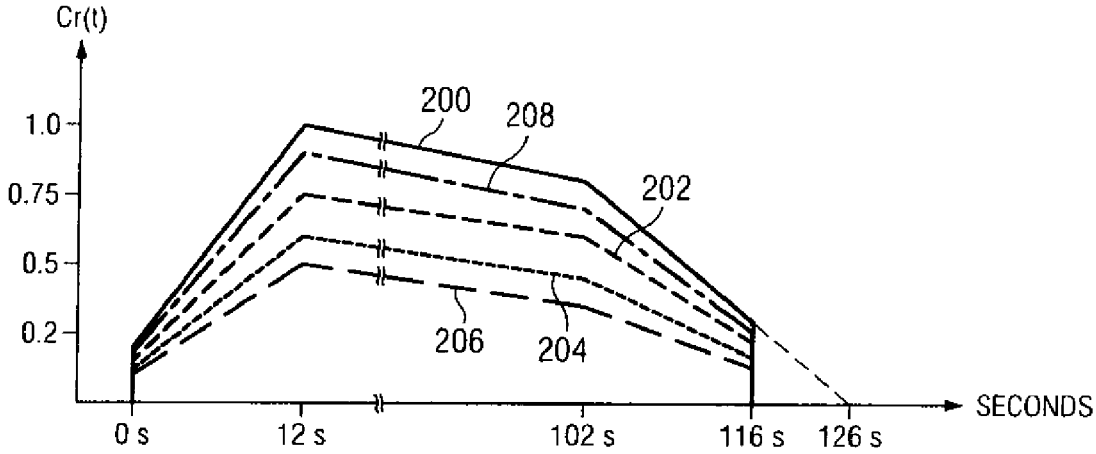
FIG. 5 is a graph of another ramping time function and other individual power profiles for radiation zones according to another embodiment of the disclosure.

Turning now to FIG. 5, a graph illustrates a second ramping time function $C_r(t)$ 200. In the second ramping time function $C_r(t)$ 200 differs from the first ramping time function $C_r(t)$ 150 in that initial value of $C_r(t)$ is 0.2 at time=0, when the printing plate enters the curing chamber 14. Additionally, the value of $C_r(t)$ linearly decreases from 1.0 to 0.75 over a 90 second time interval during the middle curing time interval, corresponding to the sustained curing interval of the curing scenario depicted in FIG. 4. Finally, the value of $C_r(t)$ at first linearly decreases at a rate that will ramp it from a value of 0.75 to 0.2 over a 24 second time interval, but at 116 seconds, the value of $C_r(t)$ drops immediately to a 0.2 value, for example in response to a signal from the second edge detector 24*b* indicating the printing plate has left the curing chamber 14. The curing scenario illustrated in FIG. 5 has been found to be beneficial when several printing plates are cured in succession. It is believed that the curing chamber 14 retains energy for at least a short time and hence less radiation is required to provide the desirable curing of the printing plate when the curing chamber 14 has recently been irradiated with energy.

For the exemplary curing scenario depicted in FIG. 5, the value of $C_s$ is 0.9 and the value of $P_{max}$ is 1.0 for the P(t) for each of the radiation zones 56*c*, 56*d*, 56*e*, 56*f*, and 56*g*. The weighting coefficient of the eighth radiation zone 56*g* $C_{w,8}$=0.5, the seventh radiation zone 56*f* $C_{w,7}$=0.6, the sixth radiation zone 56*e* $C_{w,6}$=0.6, the fifth radiation zone 56*d* $C_{w,5}$=0.8, and the fourth radiation zone 56*c* $C_{w,4}$=1.0. These weightings, used in the equation (1) above, lead to a graph of a fifth power profile $P_5(t)$ 202 representing power supplied to the fifth radiation zone 56*d*, a graph of a sixth power profile $P_6(t)$ 204 representing power supplied to the sixth radiation zone 56*e* and to the seventh radiation zone 56*f*, a graph of a seventh power profile n $P_7(t)$ 206 representing power supplied to the eighth radiation zone 56*g*, and a graph of an eighth power profile $P_8(t)$ 158 representing power supplied to the fourth radiation zone 56*c*.

Figure 6:
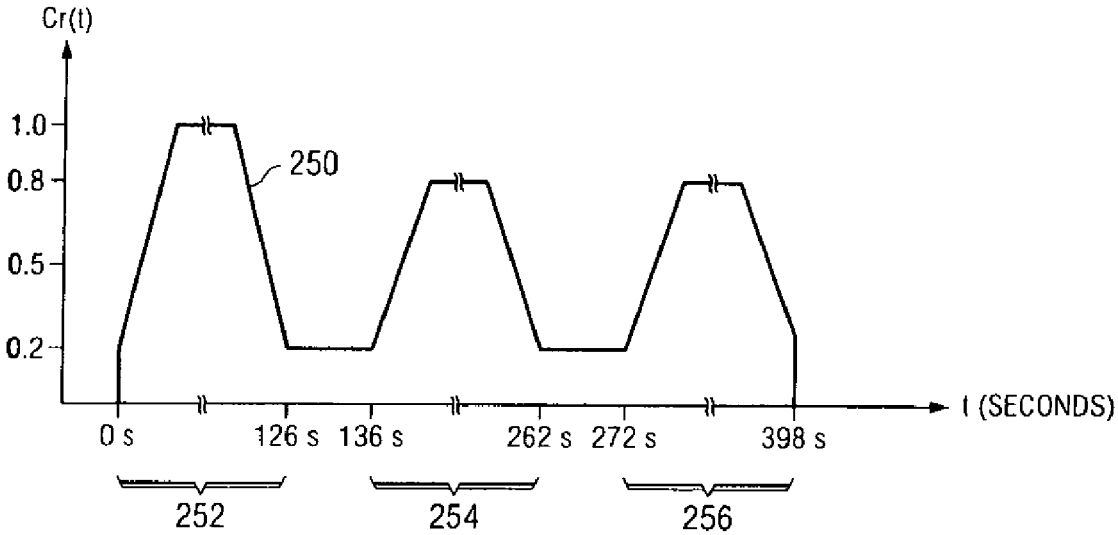
FIG. 6 is a graph of another ramping time function and other individual power profiles for radiation zones according to yet another embodiment of the disclosure.

Turning now to FIG. 6, a graph illustrates a third ramping time function $C_r(t)$ 250. This third ramping time function $C_r(t)$ is directed to curing a three printing plates one right after another. Because the curing chamber 14 is expected to retain some energy from the radiation cycle associated with curing the first printing plate during a first time interval 252, and hence the maximum value of $C_r(t)$ during a second time interval 254 and a third time interval 256 may be 0.8.

The curing scenario creation tool may support defining an arbitrary ramping time function $C_r(t)$ as a sequence of pairs, such that $C_r(t)$ ramps up or down linearly between power/time pairs. Other curing scenario templates—in addition to the linear ramp-up, sustained, linear ramp-down template described in detail above—that promote easy definition of curing scenarios are also contemplated by the present disclosure. For example, the ramping time function $C_r(t)$ may contain a non-linear ramp-up and/or a non-linear ramp-down portion. The ramping time function $C_r(t)$ may ramp to a maximum power supply level, ramp down to an intermediate power supply level, sustain the intermediate power supply level for a time duration, and then ramp down to the powered off or minimum power supply level. Temperature input from one or more temperature sensors 26 located within or adjacent to the curing chamber 14 may be employed in some curing control scenarios.

Curing scenarios or recipes may be developed through an empirical process of trial and error in the field. For example, a plurality of imaged and developed printing plates may be cured using different recipes and the curing results of each different recipe inspected to determine the effectiveness of the recipes. The inspection may involve visually examining the printing plates for a characteristic discoloration, a "browning" discoloration, indicative of excessive irradiation. The discoloration may be uniform across the whole printing plate, indicative of general excess irradiation, or may appear only in limited regions of the printing plate, indicative of zones of excessive irradiation. In the case of general excess irradiation, the maximum scenario weighting coefficient $C_s$ may be reduced. In the case of zones of excessive irradiation, correlated radiation zones may be defined and the weighting coefficient $C_w$ for the energy radiators 54 within the radiation zone associated with excessive irradiation may be reduced. The inspection may involve manually handling the printing plates to determine if the malleability and/or the tensile strength and resistance to bending is altered relative to uncured printing plates.

A technician defining curing scenarios or recipes may interpolate between two related curing scenarios. Alternately, the curing scenario creation tool may provide a capability to define a new curing scenario as an interpolation between two different curing scenarios which share the same general radiation template or functional form. Because prior art curing systems, for example convective heating ovens, may not have provided the capability to rapidly change energy levels within the curing chamber 14 and may not have provided the capability to differentially control heating across the surface area of the printing plate, there may not be an existing pool of practical knowledge of how to tune curing scenarios or recipes, leaving the default method of trial and error refinement of curing scenarios or recipes.

The controller 16 may use one or more color densitometers 28 to monitor the color of the printing plate either outside and/or inside the heating chamber to assist controlling the energy radiators 54. Color densitometers are capable of measuring colors and shades of colors to very close and repeatable tolerances. Printing plates have different colors when uncured, properly cured and over cured. The colors may vary between various types of chemical systems used for printing plates, but for a given type of plate a properly cured plate will have a consistent color. A first printing plate which has been cured and passed out of the curing chamber 14 may be monitored by an external color densitometer 28, and the controller 16, in communication with the color densitometer 28, may employ the color information to adjust the curing scenario to apply to the next printing plate to be cured. This constitutes a dynamic learning behavior of the controller 16 supported by the curing process feedback provided by the color densitometer 28. Alternately, or in addition, one or more color densitometers 28 located inside the heating chamber may monitor the color of the printing plate as it is cured, and the controller 16 may employ the color information to adjust the curing scenario of this same printing plate as it is cured.

In an embodiment, the controller 16 may compose a heat image or a thermal image of the printing plate from the inputs from a plurality of temperature sensors 26 located within the curing chamber 14. The controller 16 may compare the heat image of the printing plate to an estimated heat image of the printing plate and control the power supplied to the energy radiators 54 to make the heat image of the printing plate conform with the estimated heat image of the printing plate. This processing may take account of heat accumulation by integrating with respect to time or otherwise time wise summing the temperature analogs of which the heat image of the printing plate is composed. In the case that this integrating approach is employed, the estimated heat image will correspondingly comprise a desirable or estimated temperature integrated with respect to time or time wise summing of the temperature analogs of which the heat image of the printing plate is composed. While this heat image based energy radiation control technique may be more complex and entail greater equipment expense, it may offer advantages in some commercial applications. Alternatively, the temperature sensors 26 may compose a temperature image of a first plate after it exits the curing chamber 14 and use the image to adjust power supplied to the energy radiators 54 for a second plate passing through the chamber 14.

The HMI 112 may also monitor and store energy use per printing plate data to perform real-time costing analysis and/or to make this information available to an offline data analysis system, for example a personal computer or laptop computer connected to a communication port of the HMI 112 or a common network to which both the HMI 112 and the personal computer or laptop computer have access.

The PLC 110 and HMI 112 described above may be implemented on any general-purpose computer, special purpose computer, or digital device appropriately programmed with sufficient processing power, memory resources, input/output ports, and network throughput capability to handle the necessary workload placed upon it. When the general purpose computer, special purpose computer, or other digital device is programmed by one skilled in the art with computer logic or program steps, the general purpose computer, special purpose computer, or digital device is able to provide the functionality described above. The special purpose computer may include programmable logical controllers. A programmable logic controller is designed to perform automation tasks and activities efficiently.

Figure 7A:
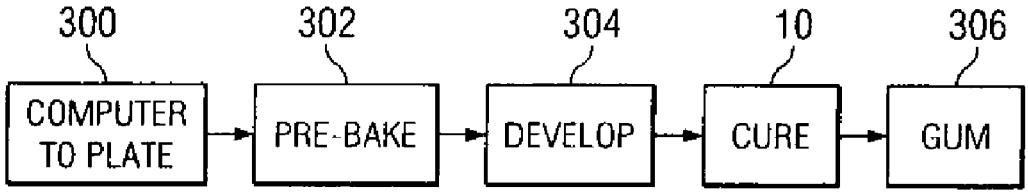
FIG. 7*a* illustrates an exemplary process using the curing system to produce a ready-to-use printing plate.

Turning now to FIG. 7*a*, an exemplary process for creating a ready-to-use printing plate using the curing system 10 is depicted. The process depicted in FIG. 7*a* may be employed with negative printing plate chemical processes. A computer-to-plate device 300 may image an unimaged printing plate. The now imaged printing plate may be moved to a pre-baking oven 302 to heat the imaged printing plate to a desirable temperature. In an embodiment, the curing system 10 may be employed in the role of the pre-baking oven 302. The pre-baked imaged printing plate may be moved to a developing device 304 where the imaged printing plate is developed, for example by using chemical processes. The developed printing plate may be moved to the curing system 10 to cure the developed printing plate. Cured printing plate may be moved to a gumming device 306 to apply a protective gum layer to the surface of the cured printing plate.

Figure 7B:
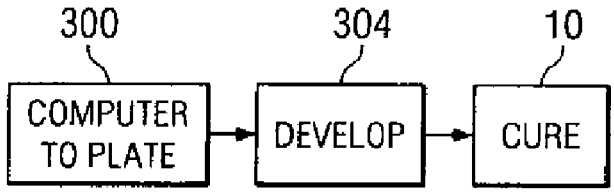
FIG. 7*b* illustrates another exemplary process using the curing system to produce a ready-to-use printing plate.

Turning now to FIG. 7*b*, an alternative exemplary process for creating a ready-to-use printing plate using the curing system 10 is depicted. The process depicted in FIG. 7*b* may be employed with positive printing plate chemical processes. A computer-to-plate device 300 may image an unimaged printing plate. The now imaged printing plate may be moved to a developing device 304 where the imaged printing plate is developed, for example by using chemical processes. The developed printing plate may be moved to the curing system 10 to cure the developed printing plate.

Figure 8:
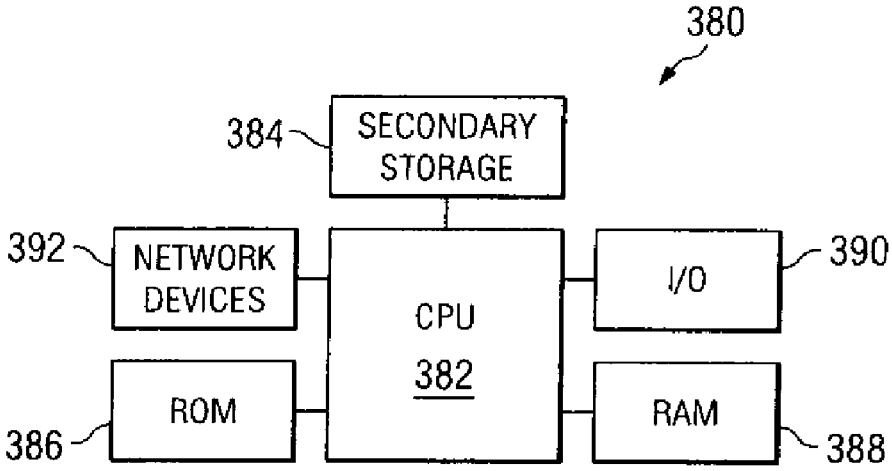
FIG. 8 illustrates an exemplary general purpose computer system suitable for implementing the several embodiments of the disclosure.

FIG. 8 illustrates a typical, general-purpose computer system suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) 390 devices, and network connectivity devices 392. The processor may be implemented as one or more CPU chips.

The secondary storage 384 is typically comprised of one or more disk drives, tape drives, compact FLASH memory, or other storage device and is used for non-volatile storage of data and as an over-flow data storage device if RAM 388 is not large enough to hold all working data. Secondary storage 384 may be used to store programs which are loaded into RAM 388 when such programs are selected for execution. Such programs may include a genetic algorithm to control power to optimize a plurality of characteristics of the printing plate changed by curing or a genetic algorithm directed to optimize the printing plate curing characteristics using stored results of a plurality of printing plate curing cycles. The ROM 386 is used to store instructions and perhaps data which are read during program execution. ROM 386 is a non-volatile memory device which typically has a small memory capacity relative to the larger memory capacity of secondary storage. The RAM 388 is used to store volatile data and perhaps to store instructions. Access to both ROM 386 and RAM 388 is typically faster than to secondary storage 384.

I/O 390 devices may include printers, video monitors, liquid crystal displays (LCDs), touch screen displays (e.g. HMI 112), keyboards, keypads, switches, dials, mice, track balls, voice recognizers, card readers, paper tape readers, or other well-known input devices. The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as Global System for Mobile Communications (GSM) radio transceiver cards, and other well-known network devices. These network connectivity 392 devices may enable the processor 382 to communicate with an Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave Such information, which may include data or instructions to be executed using processor 382 for example, may be received from and outputted to the network, for example, in the form of a computer data baseband signal or signal embodied in a carrier wave. The baseband signal or signal embodied in the carrier wave generated by the network connectivity 392 devices may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 382 executes instructions, codes, computer programs, scripts which it accesses from hard disk, floppy disk, optical disk, compact FLASH memory (these may all be considered secondary storage 384), ROM 386, RAM 388, or the network connectivity devices 392. Such programs may include a genetic algorithm to control power to optimize a plurality of characteristics of the printing plate changed by curing or a genetic algorithm directed to optimize the printing plate curing characteristics using stored results of a plurality of printing plate curing cycles.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein, but may be modified within the scope of the appended claims along with their full scope of equivalents. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as directly coupled or communicating with each other may be coupled through some interface or device, such that the items may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

What is claimed is:

1. A printing plate curing system, comprising:

a conveyer operable to move a printing plate through the curing system;

a plurality of lower energy radiators disposed below the conveyer and operable to radiate energy onto the bottom of the printing plate;

a plurality of upper energy radiators disposed above the conveyer and operable to radiate energy onto the top of the printing plate;

a controller operable to monitor a location of the printing plate and to control power supplied to the lower and upper energy radiators to radiate energy onto the printing plate; and at least one temperature sensor that provides a temperature indication and wherein the controller controls the lower and upper radiators based in part on the temperature indication of the at least one temperature sensor, wherein the energy radiators emit infrared radiation and the controller is further operable to compose the temperature indications provided by the temperature sensors as a thermal image of the printing plate and the controller controls the lower and upper radiators based on the thermal image of the printing plate.

2. The curing system of claim 1, further including an estimated thermal image of the printing plate and wherein the controller controls the lower and upper radiators based on the thermal image of the printing plate to make the thermal image of the printing plate substantially conform to the estimated thermal image of the printing plate.

3. The heating system of claim 1, further including an estimated thermal image of the printing plate representing an estimated integration with respect to time of desirable temperatures of the printing plate and wherein the controller controls the lower and upper infrared radiators based on an integration with respect to time of the thermal image of the printing plate to make the integration of the thermal image of the printing plate substantially conform to the estimated integration with respect to time of desirable temperatures of the printing plate.

4. A printing plate curing system, comprising:

a conveyer operable to move a printing plate through the curing system;

a plurality of lower energy radiators disposed below the conveyer and operable to radiate energy onto the bottom of the printing plate;

a plurality of upper energy radiators disposed above the conveyer and operable to radiate energy onto the top of the printing plate; and a controller operable to monitor a location of the printing plate and to control power supplied to the lower and upper energy radiators to radiate energy onto the printing plate, wherein the controller controls power to the lower and upper energy radiators and controls the conveyer at least in part based on one of a plurality of curing scenarios stored in the controller, each curing scenario defining a power profile for the lower and upper radiators as a function of one or more variables selected from the group consisting of a time, a position of the printing plate, and a temperature indication, wherein at least one of the printing plate curing scenarios identifies a radiator coefficient for each upper and lower radiator, a maximum power coefficient, a ramp-up time period, a maximum power time period, and a ramp-down time period and wherein the controller controls power delivered to each lower and upper radiator by linearly ramping power from substantially zero power from the stall of the ramp-up time period to substantially the radiator coefficient times the maximum power coefficient at the end of the ramp-up time period, commands power to be delivered to each lower and upper radiator in an amount equal to the radiator coefficient times the maximum power coefficient during the maximum power time period, and controls power delivered to each lower and upper radiator by linearly ramping power from the radiator coefficient times the maximum power coefficient down to substantially zero power from the start of the ramp-down time period to the end of the ramp-down time period.

5. The curing system of claim 4, wherein the controller controls power to each of the upper energy radiators and the lower energy radiators independently.

6. The curing system of claim 4, wherein the upper energy radiators and the lower energy radiators are spaced to establish radiation zones.

7. The curing system of claim 6, wherein each radiation zone comprises one or more energy radiators and the controller provides the same power level to each energy radiator in a radiation zone.

8. The curing system of claim 4, further including an at least one temperature sensor that provides a temperature indication and wherein the controller controls the lower and upper radiators based in part on the temperature indication of the at least one temperature sensor.

9. The curing system of claim 4, wherein the controller includes a human machine interface operable to define one of the curing scenarios and to select one of the curing scenarios for use in controlling the lower and upper energy radiators.

10. The curing system of claim 4, wherein the conveyer moves the printing plate discontinuously.

11. The printing plate curing system of claim 4, wherein the energy radiators are selected from the group comprising infrared lamps and ultraviolet lamps.

12. The printing plate curing system of claim 4, further comprising:

a curing chamber having a top, a bottom, two opposed sides and two opposed ends, each end having an opening through which the conveyor passes, each side and end having an inner surface, and an extraction system comprising conduits having a plurality of ports distributed along the inner surfaces of the two opposed sides and positioned proximate the conveyer, and a source of pressure lower than ambient air pressure coupled to the conduits, whereby air in the curing chamber is drawn into the ports.

13. The printing plate curing system of claim 12, further comprising:

a plurality of ports distributed along the inner surfaces of the two opposed ends and positioned proximate the conveyer, and coupled to the source of pressure lower than ambient air pressure, whereby air in the curing chamber is drawn into the ports.

14. The curing system of claim 4, wherein the conveyer is formed of one of a mesh material, a webbing material, and an energy transparent material.

15. The curing system of claim 4, wherein the conveyer is formed of one of a mesh material and a webbing material and structural elements of the conveyer are not energy transparent.

16. The curing system of claim 4, wherein the conveyer is formed of one of a mesh material, and a webbing material and spaces between structural elements of the conveyer allow airflow for convective or forced air heating and cooling.

17. A printing plate curing system, comprising:

a conveyer operable to move a printing plate through the curing system;

a plurality of lower energy radiators disposed below the conveyer and operable to radiate energy onto the bottom of the printing plate;

a plurality of upper energy radiators disposed above the conveyer and operable to radiate energy onto the top of the printing plate; and a controller operable to monitor a location of the printing plate and to control power supplied to the lower and upper energy radiators to radiate energy onto the printing plate, wherein the controller controls power to the lower and upper energy radiators and controls the conveyer at least in part based on one of a plurality of curing scenarios stored in the controller, each curing scenario defining a power profile for the lower and upper radiators as a function of one or more variables selected from the group consisting of a time, a position of the printing plate, and a temperature indication, further comprising, a plurality of solid state control relays operable to provide variable power to the lower and upper infrared radiators; and a plurality of programmable logic controllers operable to receive one or more control inputs from the controller and to control the power delivered by the solid state control relays based on the control inputs.

18. A printing plate curing system comprising:

a conveyer operable to move a printing plate through the curing system;

a plurality of lower energy radiators disposed below the conveyer and operable to radiate energy onto the bottom of the printing plate;

a plurality of upper energy radiators disposed above the conveyer and operable to radiate energy onto the top of the printing plate;

a controller operable to monitor a location of the printing plate and to control power supplied to the lower and upper energy radiators to radiate energy onto the printing plate;

a curing chamber having a top, a bottom, two opposed sides and two opposed ends, each end having an opening through which the conveyer passes, each side and end having an inner surface;

an extraction system comprising conduits having a plurality of ports distributed along the inner surfaces of the two opposed sides and positioned proximate the conveyer, and a source of pressure lower than ambient air pressure coupled to the conduits, whereby air in the curing chamber is drawn into the ports; and a plurality of ports distributed along the inner surfaces of the two opposed ends and positioned proximate the conveyer, and coupled to the source of pressure lower than ambient air pressure, whereby air in the curing chamber is drawn into the ports;

wherein the source of pressure is a multispeed fan and the controller is operable to select fan speed.

19. The curing system of claim 18, wherein the conveyer is formed of one of a mesh material, and a webbing material and spaces between structural elements of the conveyer allow airflow for convective or forced air heating and cooling.

* * * * *

UNITED STATES PATENT AND TRADEMARK OFFICE

CERTIFICATE OF CORRECTION

PATENT NO. : 7,225,560 B2
APPLICATION NO. : 11/051277
DATED : June 5, 2007
INVENTOR(S) : Govek et al.

It is certified that error appears in the above-identified patent and that said Letters Patent is hereby corrected as shown below:

Col. 14, line 33, replace “stall” with -- start--

Signed and Sealed this

Twenty-fourth Day of July, 2007

JON W. DUDAS
*Director of the United States Patent and Trademark Office*